US008980018B2

(12) United States Patent
Hamada et al.

(10) Patent No.: US 8,980,018 B2
(45) Date of Patent: Mar. 17, 2015

(54) FERRITIC STAINLESS STEEL SHEET EXCELLENT IN HEAT RESISTANCE AND WORKABILITY AND METHOD OF PRODUCTION OF SAME

(75) Inventors: Junichi Hamada, Tokyo (JP); Shinichi Teraoka, Tokyo (JP); Yoshiharu Inoue, Tokyo (JP); Norihiro Kanno, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 244 days.

(21) Appl. No.: 13/636,391

(22) PCT Filed: Mar. 25, 2011

(86) PCT No.: PCT/JP2011/058373

§ 371 (c)(1),
(2), (4) Date: Sep. 21, 2012

(87) PCT Pub. No.: WO2011/118854

PCT Pub. Date: Sep. 29, 2011

(65) Prior Publication Data

US 2013/0008573 A1 Jan. 10, 2013

(30) Foreign Application Priority Data

Mar. 26, 2010 (JP) ..... 2010-072889

(51) Int. Cl.
*C22C 38/20* (2006.01)
*C22C 38/26* (2006.01)
(Continued)

(52) U.S. Cl.
CPC ..... *C22C 38/02* (2013.01); *C21D 6/002* (2013.01); *C21D 9/46* (2013.01); *C22C 38/001* (2013.01); *C22C 38/04* (2013.01); *C22C 38/06* (2013.01); *C22C 38/20* (2013.01); *C22C 38/26* (2013.01); *C22C 38/28* (2013.01); *C22C 38/32* (2013.01); *C21D 8/02* (2013.01); *C21D 8/0205* (2013.01);
(Continued)

(58) Field of Classification Search
None
See application file for complete search history.

(56) References Cited

U.S. PATENT DOCUMENTS

2009/0092513 A1 4/2009 Hamada et al.
2011/0176954 A1 7/2011 Oku et al.

FOREIGN PATENT DOCUMENTS

JP 08-260104 10/1996
JP 2000-297355 10/2000
(Continued)

OTHER PUBLICATIONS

Machine-English translation of Japanese patent No. 08-260104, Fujisawa Mitsusachi et al., Oct. 8, 1996.*
(Continued)

*Primary Examiner* — Deborah Yee
(74) *Attorney, Agent, or Firm* — Kenyon & Kenyon LLP

(57) ABSTRACT

Ferritic stainless steel sheet for an exhaust part which has little deterioration in strength even if undergoing long term heat history and is low in cost, excellent in heat resistance and workability characterized by containing, characterized by containing, by mass %, C: less than 0.010%, N: 0.020% or less, Si: over 0.1% to 2.0%, Mn: 2.0% or less, Cr: 12.0 to 25.0%, Cu: over 0.9 to 2%, Ti: 0.05 to 0.3%, Nb: 0.001 to 0.1%, Al: 1.0% or less, and B: 0.0003 to 0.003%, having a Cu/(Ti+Nb) of 5 or more, and having a balance of Fe and unavoidable impurities.

9 Claims, 1 Drawing Sheet

(51) Int. Cl.

| | |
|---|---|
| ***C21D 8/02*** | (2006.01) |
| ***C22C 38/02*** | (2006.01) |
| ***C21D 6/00*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |

(52) U.S. Cl.

CPC ..... *C22C 38/004* (2013.01); *C21D 2211/005* (2013.01)

USPC ..... 148/326; 148/325; 148/608; 148/609; 420/60; 420/70

(56) References Cited

FOREIGN PATENT DOCUMENTS

| | | |
|---|---|---|
| JP | 2000-303149 | 10/2000 |
| JP | 2001-020046 | 1/2001 |
| JP | 2001-288543 | 10/2001 |
| JP | 3397167 | 4/2003 |
| JP | 3446667 | 9/2003 |
| JP | 3468156 | 11/2003 |
| JP | 2006-037176 | 2/2006 |
| JP | 2006-328525 | 12/2006 |
| JP | 2008-240143 | 10/2008 |
| WO | WO 03/004714 | 1/2003 |

OTHER PUBLICATIONS

Machine-English translation of Japanese patent No. 2008-190003, Hiraide Nobuhiko et al., Aug. 21, 2008.*

International Search Report dated Jun. 21, 2011, issued in corresponding PCT Application No. PCT/JP2011/058373.

PCT/IPEA/409 in Japanese issued in corresponding PCT Application No. PCT/JP2011/058373, Dec. 3, 2012.

* cited by examiner

FERRITIC STAINLESS STEEL SHEET EXCELLENT IN HEAT RESISTANCE AND WORKABILITY AND METHOD OF PRODUCTION OF SAME

This application is a national stage application of International Application No. PCT/JP2001/058373, filed Mar. 25, 2011, which claims priority to Japanese Application No. 2010-072889, filed Mar. 26, 2010, the content of which is incorporated by reference in its entirety.

TECHNICAL FIELD

The present invention relates to ferritic stainless steel sheet excellent in heat resistance which is particularly suitable for use for an exhaust system member etc. which requires high temperature strength and oxidation resistance.

BACKGROUND ART

Exhaust manifolds, front pipes, center pipes, and other exhaust system members of automobiles carry high temperature exhaust gas which is exhausted from the engine, so the materials forming the exhaust members are required to offer oxidation resistance, high temperature strength, heat fatigue characteristics, and diverse other characteristics.

In the past, cast iron has generally been used for automobile exhaust members, but from the viewpoint of the toughening of exhaust gas regulations, improvement of engine performance, reduction of the weight of chasses, etc., stainless steel exhaust manifolds are being used.

The temperature of exhaust gas differs depending on the vehicle type and engine structure, but often becomes 600 to 800° C. or so. In environments of long term use in such a temperature region, materials which have an excellent high temperature strength and oxidation resistance are being demanded.

Among stainless steels, austenitic stainless steel is excellent in heat resistance and workability. However, austenitic stainless steel has a large heat expansion coefficient, so if used for members which are repeatedly heated and cooled such as exhaust manifolds, heat fatigue fracture easily occurs.

On the other hand, ferritic stainless steel has a smaller heat expansion coefficient compared with austenitic stainless steel, so is excellent in heat fatigue characteristics and scale spalling resistance. Further, it does not contain Ni, so compared with austenitic stainless steel, the cost of material is low. Therefore, this is being used for general applications.

Ferritic stainless steel is lower in high temperature strength compared with austenitic stainless steel. Art for improving the high temperature strength has been developed.

As ferritic stainless steel improved in high temperature strength, for example, there are SUS430J1 (Nb steel), Nb—Si steel, and SUS444 (Nb—Mo steel). These all use solution strengthening or precipitation strengthening by addition of Nb so as to raise the high temperature strength.

Nb steel has the problem of hardening of the finished sheet, a drop in elongation, and a low r-value—an indicator of deep drawability.

Hardening of the finished sheet is a phenomenon where the presence of dissolved Nb and precipitated Nb causes hardening at ordinary temperature.

Development of the recrystallized texture is suppressed, so the elongation falls, the r-value becomes lower, and the press formability and shape freedom when forming the exhaust parts become lower.

Further, Nb is high in material cost. If added in a large amount, the manufacturing cost rises.

If excellent high temperature characteristics can be obtained by additive elements other than Nb, it would be possible to keep down the amount of addition of Nb and provide heat resistant ferritic stainless steel sheet which is low in cost and excellent in workability.

PLT's 1 to 6 disclose art relating to the addition of Cu.

In PLT 1, to improve low temperature toughness, addition of 0.5% or less of Cu is being studied.

The art which is described in PLT 2 is art which utilizes the action of Cu of raising the corrosion resistance and weather resistance.

PLT's 3 to 6 disclose the art which utilizes precipitation strengthening by Cu precipitates to improve the high temperature strength in the 600° C. or 700 to 800° C. temperature range.

These arts all require the addition of Nb. This is a problem in terms of the cost and workability.

Further, regarding improvement of the high temperature strength utilizing Cu precipitates, if the Cu precipitates are exposed to a high temperature over a long term, coarsening due to aggregation and combination of precipitate rapidly proceeds, so the precipitation strengthening ability remarkably falls.

As a result, if used for a member such as an exhaust manifold which is subjected to thermal cycles along with engine startup and stopping, long term use causes a remarkable drop in high temperature strength and the danger of heat fatigue fracture.

Further, in a system of ingredients in which Nb is added in a large amount, Cu precipitates at the coarse Laves phase and matrix phase interface at the time of high temperature heating, so the effect of precipitation strengthening by Cu precipitates is not obtained.

PLT 6 discloses the art of using composite addition of Nb—Cu—B to cause fine Cu to precipitate. However, composite precipitation with the Laves phases cannot be avoided. Furthermore, addition of a fine amount of Mo is necessary. There is a problem in workability or cost.

CITATIONS LIST

Patent Literature

PLT 1: Japanese Patent Publication No. 2006-37176 A1

PLT 2: Japanese Patent No. 3446667

PLT 3: International Patent Publication WO2003/004714 A1

PLT 4: Japanese Patent No. 3468156 PLT 5: Japanese Patent No. 3397167

PLT 6: Japanese Patent Publication No. 2008-240143 A1

SUMMARY OF INVENTION

Technical Problem

From the viewpoint of heat resistance, the inventors engaged in studies to cause fine precipitation of Cu so as to improve the high temperature strength, but the results were insufficient from the viewpoint of workability and cost. Further, the problem of the large drop in strength accompanying coarsening of the precipitates when held at a high temperature for a long time was solved.

Ferritic stainless steel for exhaust parts which is low in cost and superior in strength stability which solves these problems is therefore being demanded.

The present invention has as its object the provision of ferritic stainless steel excellent in heat resistance and workability which is high in stability of high temperature strength even if under a hot environment over a long period of time. In particular, it has as its object the inexpensive provision of ferritic stainless steel for exhaust parts from which high workability and strength are demanded and which is suitable for exhaust parts which are used in a hot environment of 600 to 800° C.

Solution to Problem

To solve this problem, the inventors investigated in detail the precipitation behavior and coarsening behavior of Cu and the high temperature strength at 600 to 800° C. while considering the effects of Ti and Nb.

As a result, they discovered that by adjusting the amounts of Cu, Ti, and Nb, it is possible to suppress the coarsening of Cu precipitates accompanying heat treatment at a high temperature over a long period of time (aging) and cause the effective action of precipitation strengthening by Cu precipitates even after aging over a long period of time.

Specifically, the inventors discovered that by making Cu/(Ti+Nb) 5 or more, even if performing long term heat treatment at 600 to 800° C. for aging, it is possible to achieve a high temperature strength of at least that of conventional steel which contains a large amount of Nb.

This is extremely effective for the endurable stability of parts which undergo repeated thermal cycles and which are used over long periods of time like exhaust members.

As explained above, if heating Nb steel or Nb—Ti composite steel in a temperature range of 600 to 800° C. over a long period of time, intermetallic compounds of Fe and Nb or Fe and Ti (respectively $Fe_2Nb$ and $Fe_2Ti$) are formed. These form precipitates called "Laves phases" which rapidly coarsen along with time resulting in a reduction of the dissolved Nb and dissolved Ti.

In such a state, the effects of precipitation strengthening by Laves phases and solution strengthening by dissolved Nb and dissolved Ti cannot be obtained, so the high temperature strength falls.

Further, due to this, the heat fatigue characteristics and creep characteristics deteriorate, part damage progresses faster, and fracture ensues.

If adding Cu, the fine precipitation of Cu causes precipitation strengthening, but if Nb and Ti are simultaneously added in large amounts, they compositely precipitate with the Laves phases and the effect of fine precipitation becomes smaller.

The inventors discovered the method of keeping the amounts of addition of Ti and Nb lower than the amount of addition of Cu so as to suppress the precipitation of Laves phases or utilizing the action of fine precipitation strengthening of the Laves phases and Nb or Ti clusters so as to cause fine precipitation of Cu.

The Cu which is precipitated in this way suppresses coarsening and improves the stability of the high temperature strength even after heat treatment over a long period of time.

From the above discoveries, the present invention enables the stability of fine Cu precipitates to be secured and for ferritic stainless steel sheet for exhaust part use which has excellent heat resistance to be inexpensively provided.

The gist of the present invention is as follows:

(1) Ferritic stainless steel sheet excellent in heat resistance and workability characterized by containing, by mass %, C: less than 0.010%, N: 0.020% or less, Si: over 0.1% to 2.0%, Mn: 2.0% or less, Cr: 12.0 to 25.0%, Cu: over 0.9% to 2.0%, Ti: 0.05 to 0.3%, Nb: 0.001 to 0.1%, Al: 1.0% or less, and B: 0.0003 to 0.0030%, having contents of Cu, Ti, and Nb satisfying Cu/(Ti+Nb) ≥5, and having a balance of Fe and unavoidable impurities.

(2) Ferritic stainless steel sheet excellent in heat resistance and workability of (1) characterized by further containing, by mass %, one or more of Mo: 0.50% or less, V: 0.50% or less, and Sn: 0.50% or less.

(3) Method of production of ferritic stainless steel sheet excellent in heat resistance and workability characterized by hot rolling a slab which has a composition of (1) or (2), then performing heat treatment at 700 to 850° C. for 1 to 100 hr, then cold rolling and annealing.

Advantageous Effects of Invention

According to the present invention, even if not adding Nb in a large amount, ferritic stainless steel sheet which is excellent in high temperature strength and workability is obtained. In particular, by using this for exhaust manifolds, front pipes, center pipes, or other exhaust system members, a great effect is obtained in preservation of the environment, reduction of the cost of parts, etc.

DESCRIPTION OF EMBODIMENTS

Figure 1:
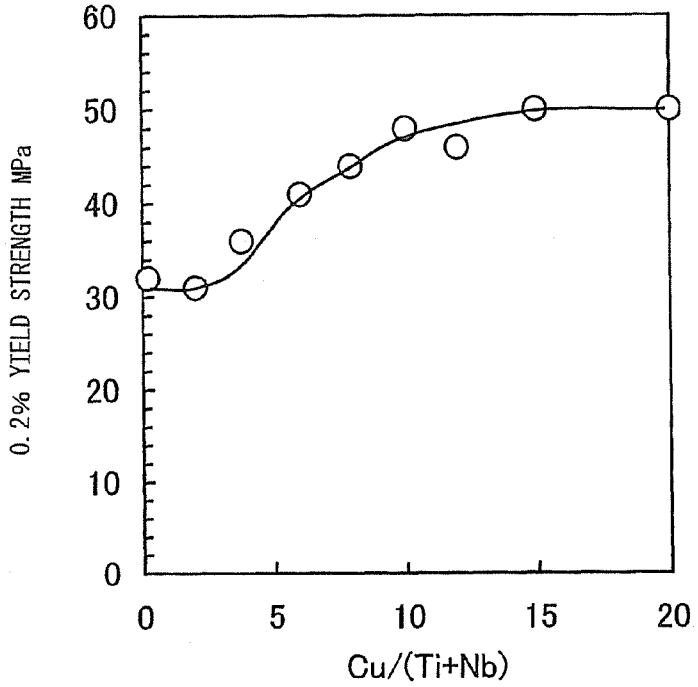
FIG. 1 is a view which shows the relationship between the value of Cu/(Ti+Nb) and the 0.2% yield strength at 700° C. after heat treatment for aging at 700° C. for 100 hours.

First, the composition of ingredients of the stainless steel of the present invention will be explained. Below, "%" means "mass %".

In each composition of ingredients, the absence of provision of a lower limit of content indicates inclusion up to the level of an unavoidable impurity.

C causes deterioration of the formability and corrosion resistance and causes a drop in the high temperature strength, so the smaller the content, the better. Accordingly, the content of C is made less than 0.010%. If excessively reducing the content of C, the refining costs increase. If considering the oxidation resistance as well, the content of C is preferably 0.002 to 0.009%.

N, in the same way as C, degrades the formability and corrosion resistance and causes a drop in the high temperature strength, so the smaller the content, the better. Accordingly, the content of N is made 0.020% or less. If excessively reducing the content of N, the refining costs increase. If considering the oxidation resistance as well, the content is preferably 0.002 to 0.015%.

Si is an element which is useful as a deoxidizing agent. To obtain an effect as a deoxidizing agent, over 0.1% has to be added. Further, Si causes an improvement of the oxidation resistance and high temperature strength, but if the content exceeds 2.0%, the workability is remarkably degraded. Furthermore, the formation of Laves phases is promoted. Therefore, the content of Si is made 2.0% or less. If considering the manufacturability, high temperature strength, and oxidation resistance, the content of Si is preferably 0.2 to 1.5%.

Mn is an element which is added as a deoxidizing agent. Further, it contributes to the rise of high temperature strength in the temperature range of 600 to 800° C. or so. Further, during long term use, it forms Mn-based oxides at the surface layer which contribute to the improvement of scale adhesion and suppression of abnormal oxidation. If the content of Mn exceeds 2.0%, ordinary temperature ductility drops. Furthermore, due to the formation of MnS, the corrosion resistance falls. If considering the ordinary temperature ductility and the scale adhesion, the content of Mn is preferably 0.1 to 1.5%.

Cr is an element which is essential for obtaining the required oxidation resistance and corrosion resistance. If the content of Cr is less than 12.0%, that effect is not obtained. If the content of Cr is over 25.0%, it causes a drop in workability and deterioration of the toughness. Accordingly, the content of Cr is made 12.0 to 25.0%. If considering the manufacturability and high temperature ductility, 12.5 to 20.0% is preferable.

Cu is an element which is effective for improvement of the high temperature strength in the temperature region of 600 to 800° C. This effect is mainly due to precipitation strengthening by the Cu precipitates in the temperature region of 600 to 800° C.

To obtain this effect, the content of Cu has to be made over 0.90%. If the content of Cu exceeds 2.0%, cracks are formed at the time of hot rolling and the ordinary temperature ductility remarkably falls.

Accordingly, the content of Cu is made over 0.9 to 2.0%. If considering the strength stability, oxidation resistance, and weldability, the content is preferably 1.0 to 1.5%. Ti is an element which bonds with C, N, and S to improve the corrosion resistance, intergranular corrosion resistance, ordinary temperature ductility, and deep drawability. Further, Ti clusters and the precipitation of fine Ti(C, N) cause effective improvement of the high temperature strength due to the interaction with Cu precipitates.

To obtain these effects, Ti must be added in an amount of 0.05% or more. If the content of Ti is over 0.3%, $Fe_2Ti$ is produced and becomes a composite precipitation site for Cu precipitates resulting in Cu coarsely precipitating. Accordingly, the content of Ti is made 0.05 to 0.3%. If considering the oxidation resistance and the manufacturability, 0.07 to 0.2% is preferable.

Nb is an element which improves the high temperature strength. However, it is expensive, so the content is preferably small. If adding Nb in an amount of 0.001% or more, $Fe_2Nb$ precipitates extremely finely. Due to the interaction with the Cu precipitate, the high temperature strength is effectively improved. If the amount of addition of Nb exceeds 0.1%, $Fe_2Nb$ coarsely forms. Along with this, Cu also coarsely precipitates, so the improvement in high temperature strength is poor and aging becomes vigorous. Accordingly, the content of Nb is made 0.001 to 0.1%. If considering manufacturability and workability, 0.001 to 0.05% is desirable. Al acts as a deoxidizing element and also has the effect of improving the oxidation resistance. Al can be added in an amount of 1.0% or less in accordance with need, but need not necessarily be added. Further, Al is useful for improvement of strength at 600 to 700° C. as a solution strengthening element, but if the amount of addition is over 1.0%, the steel hardens, uniform elongation is remarkably degraded, and, furthermore, the toughness remarkably falls. If considering the occurrence of surface defects and the weldability and manufacturability, 0.01 to 0.50% is preferable.

B is an element which improves the secondary workability at the time of press-forming a product. To obtain this effect, the content of B has to be made 0.0003% or more. If adding over B, hardening, intergranular corrosion due to formation of precipitates of Cr and B, and weld cracks form. Accordingly, the content of B is made 0.0003 to 0.0030%. If considering the manufacturability, 0.0003 to 0.0015% is preferable.

In the ferritic stainless steel sheet of the present invention, the contents of Cu, Ti, and Nb have to satisfy $Cu/(Ti+Nb) \geq 5$.

FIG. 1 shows the relationship between Cu/(Ti+Nb) and the 0.2% yield strength at 700° C. after heat treatment at 700° C. for 100 hours. From FIG. 1, it is learned that if Cu/(Ti+Nb) is 5 or more and the yield strength becomes the high temperature strength of general use Nb steel or more.

Figure 2:
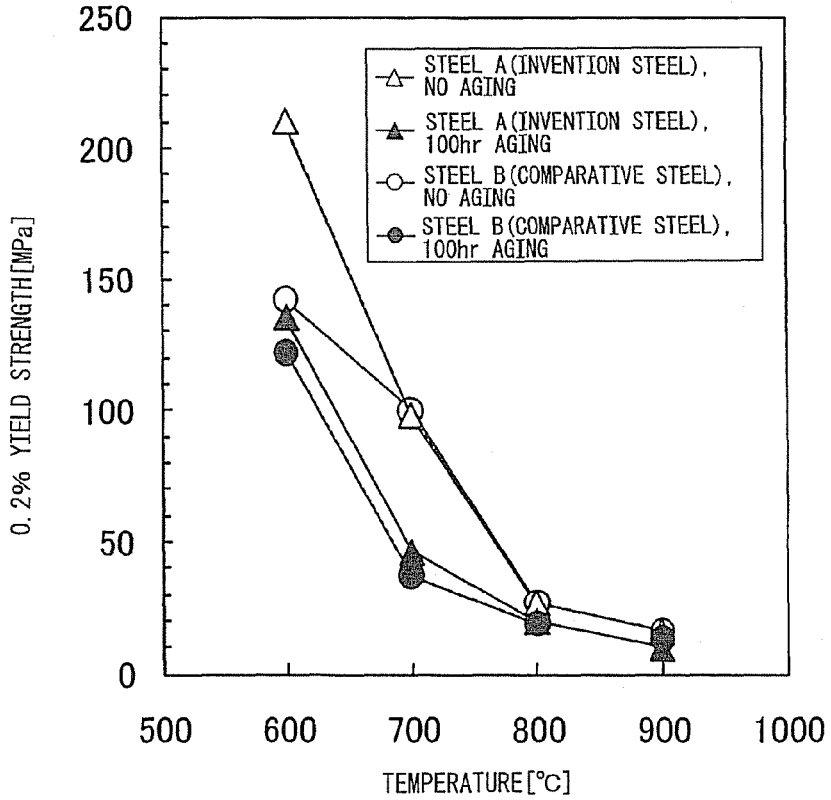
FIG. 2 is a view which shows the 0.2% yield strength at a high temperature tensile test of the invention steels and comparative steels.

FIG. 2 shows the results of a high temperature tensile test of the Cu steel comprised of the steel A (invention steel) (0.006% C-0.009% N-0.86% Si-0.28% Mn-13.9% Cr-1.21% Cu-0.10% Ti-0.001% Nb-0.07% A1-0.0005% B, Cu/(Ti+Nb)= 10) and the general use Nb steel comprised of the steel B (comparative steel) (0.006% C-0.009% N-0.90% Si-0.35% Mn-13.8% Cr-0.45% Nb).

For the high temperature tensile test, a tensile test was run in the rolling direction based on JIS G0567.

The 0.2% yield strength at 600, 700, 800, and 900° C. were measured.

Further, the steels were heat treated at the different temperatures for 100 hours, then were subjected to tensile tests at the different temperatures. The results are shown in the same figure.

The triangle marks in FIG. 2 show the steel A, while the circle marks shown the steel B. Further, the white marks show the results of the tensile tests without aging while the black marks show the results of the tensile tests after 100 hours aging treatment.

In the results of the tensile tests without aging, the steel A has a higher high temperature yield strength at 600 to less than 700° C. compared with the general use Nb steel comprised of the steel B and exhibited an equal or better high temperature yield strength at 800° C. or more.

After the heat treatment for aging, a tensile test was run. As a result, the steel A exhibited a high temperature yield strength of the Nb steel comprised of the steel B or more. It was learned that it was superior in long term strength stability.

That is, it is learned that the stainless steel of the present invention has heat resistance equal to or better than general use Nb steel and is superior in heat resistance.

Accordingly, the Cu/(Ti+Nb) of the steel ingredients in the present invention is made 5 or more. From FIG. 1, it is learned that if Cu/(Ti+Nb) becomes 15 or so, the strength becomes saturated. If considering manufacturability and workability, the upper limit of Cu/(Ti+Nb) is preferably made 15.

The ferritic stainless steel sheet of the present invention may have one or more of Mo, V, and Sn further added to it in accordance with the usage environment.

These elements act to improve the high temperature strength and corrosion resistance, but are expensive, so are made 0.5% or less. If considering the manufacturability and weldability, 0.01 to 0.3% is preferable.

Next, the method of production of the ferritic stainless steel sheet of the present invention will be explained.

The method of production of the ferritic stainless steel sheet of the present invention is comprised of steps of steelmaking, hot rolling, pickling, cold rolling, annealing, and pickling.

The steelmaking is suitably performed by smelting steel which contains the above essential ingredients and optional ingredients which are added in accordance with need in a converter, then performing secondary refining. The melted steel is made into a slab by a known casting method (continuous casting).

The slab is heated to a predetermined temperature, then is hot rolled to a predetermined sheet thickness by continuous rolling.

The cold rolling of the stainless steel sheet is reverse rolling by a Sendzimer rolling mill of a roll diameter of 60 to 100 mm or one-directional rolling by a tandem rolling mill of a roll diameter of 400 mm or more. In the present invention, either rolling method may be employed. To raise the r-value, which is an indicator of the workability, it is preferable to perform cold rolling by a tandem rolling mill with a roll diameter of 400 mm or more. Tandem rolling is superior in productivity compared with Sendzimer rolling.

In the method of production of the stainless steel sheet of the present invention, from the viewpoint of productivity, it is also possible to omit the annealing of the hot rolled sheet which is normally performed in the production of ferritic stainless steel sheet. However, if heat treating the hot rolled steel sheet at 700 to 850° C. for 1 to 100 hr, then cold rolling and annealing, the workability is further improved.

If cold rolling, then recrystallizing and annealing the Cu steel, Cu precipitates in the annealing process and therefore the recrystallization is retarded. As a result, development of the recrystallized texture (where sheet surface and <111> direction are perpendicular) is suppressed and the r-value, an indicator of the deep drawability, is not improved.

On the other hand, when causing precipitation of Cu before cold rolling, then cold rolling, recrystallizing, and annealing, Cu is precipitated before the annealing process, so in the annealing process, no delay occurs in recrystallization due to the precipitation phenomenon. However, in the state where Cu has finely precipitated, an action arises which stops dislocation and movement of crystal grain boundaries, so the formation of recrystallized grains is retarded.

In the present invention, the inventors researched in detail the relationship between the recrystallized texture and the precipitated state of the Cu. As a result, they learned that if the size of the precipitated particles of Cu before cold rolling is 50 nm or more, no delay occurs in recrystallization and the r-value can be improved.

Furthermore, as the method of heat treatment for obtaining this state, the hot rolled steel sheet is heat treated at 700 to 850° C. for 1 to 100 hr, then is cold rolled and annealed to thereby obtain steel sheet which is excellent in deep drawability.

The rest of the steps of the method are not particularly prescribed. The hot rolling conditions, hot rolled sheet thickness, cold rolled sheet annealing temperature, atmosphere, etc. may be suitably selected. Further, after the cold rolling and annealing, it is possible to perform temper rolling or run the sheet through a tension leveler. The finished sheet thickness may be selected in accordance with the thickness of the member demanded.

EXAMPLES

Steel of each of the compositions of ingredients which are shown in Table 1 was smelted and cast into a slab. Each slab was hot rolled to a hot rolled coil of 5 mm thickness. After that, the hot rolled coil was pickled, cold rolled to 2 mm thickness, annealed, and pickled to obtain finished sheet. The annealing temperature of the cold rolled sheet was made 850 to 1000° C. so as to make the crystal grain size no. about 6 to 8.

TABLE 1

| | Steel | Content of ingredients (mass %) | | | | | | | | | | | | | |
|---|---|---|---|---|---|---|---|---|---|---|---|---|---|---|---|
| | no. | C | N | Si | Mn | Cr | Cu | Ti | Nb | B | Al | Mo | V | Sn | Cu/(Ti + Nb) |
| Inv. | 1 | 0.006 | 0.009 | 0.86 | 0.28 | 13.9 | 1.21 | 0.10 | 0.001 | 0.0003 | 0.07 | — | — | — | 12 |
| ex. | 2 | 0.004 | 0.010 | 0.11 | 0.09 | 17.2 | 1.19 | 0.20 | 0.005 | 0.0005 | 0.07 | — | — | — | 6 |
| | 3 | 0.004 | 0.009 | 0.84 | 0.35 | 14.2 | 1.52 | 0.08 | 0.05 | 0.0003 | 0.04 | — | — | — | 12 |
| | 4 | 0.002 | 0.008 | 0.39 | 0.41 | 12.4 | 1.25 | 0.14 | 0.07 | 0.0008 | 0.01 | — | — | — | 6 |
| | 5 | 0.006 | 0.009 | 0.15 | 0.10 | 17.1 | 1.51 | 0.19 | 0.001 | 0.0008 | 0.15 | — | — | — | 8 |
| | 6 | 0.008 | 0.013 | 0.82 | 1.05 | 13.7 | 1.31 | 0.09 | 0.001 | 0.0005 | 0.05 | — | — | — | 14 |
| | 7 | 0.009 | 0.013 | 0.95 | 0.16 | 17.5 | 1.26 | 0.19 | 0.06 | 0.0005 | 0.88 | — | — | — | 5 |
| | 8 | 0.005 | 0.013 | 0.77 | 0.29 | 13.7 | 1.36 | 0.11 | 0.09 | 0.0003 | 0.07 | 0.15 | — | — | 7 |
| | 9 | 0.006 | 0.015 | 0.11 | 0.12 | 16.9 | 1.27 | 0.19 | 0.04 | 0.0013 | 0.07 | — | 0.25 | — | 6 |
| | 10 | 0.004 | 0.019 | 0.33 | 0.25 | 14.5 | 1.25 | 0.08 | 0.05 | 0.0003 | 0.04 | — | — | 0.19 | 10 |
| Comp. | 11 | 0.006 | 0.009 | 0.90 | 0.35 | 13.8 | — | — | 0.45 | — | 0.05 | — | — | — | 0 |
| ex. | 12 | 0.025 | 0.010 | 0.90 | 0.53 | 13.8 | 1.36 | 0.09 | 0.001 | 0.0005 | 0.11 | — | — | — | 15 |
| | 13 | 0.003 | 0.029 | 0.46 | 0.50 | 14.5 | 1.33 | 0.26 | 0.001 | 0.0012 | 0.09 | — | — | — | 5 |
| | 14 | 0.011 | 0.012 | 2.50 | 1.10 | 11.5 | 1.26 | 0.13 | 0.005 | 0.0015 | 0.01 | — | — | — | 9 |
| | 15 | 0.013 | 0.019 | 0.23 | 2.80 | 18.5 | 1.06 | 0.22 | 0.001 | 0.0005 | 0.19 | — | — | — | 5 |
| | 16 | 0.008 | 0.006 | 1.28 | 1.00 | 9.3 | 0.98 | 0.06 | 0.000 | 0.0008 | 0.55 | — | — | — | 16 |
| | 17 | 0.012 | 0.007 | 0.93 | 0.13 | 11.5 | 0.56 | 0.11 | 0.001 | 0.0003 | 0.03 | — | — | — | 5 |
| | 18 | 0.005 | 0.008 | 0.75 | 0.35 | 16.3 | 2.50 | 0.11 | 0.005 | 0.0009 | 0.01 | — | — | — | 22 |
| | 19 | 0.005 | 0.009 | 0.96 | 0.25 | 14.0 | 1.21 | 0.06 | 0.35 | 0.0005 | 0.06 | — | — | — | 3 |
| | 20 | 0.008 | 0.013 | 0.15 | 0.55 | 14.5 | 1.53 | 0.56 | 0.005 | 0.0002 | 0.06 | — | — | — | 3 |
| | 21 | 0.012 | 0.006 | 0.82 | 1.25 | 13.5 | 1.33 | 0.15 | 0.001 | 0.0055 | 0.07 | — | — | — | 9 |
| | 22 | 0.010 | 0.013 | 0.58 | 1.56 | 13.5 | 1.15 | 0.13 | 0.001 | 0.0006 | 1.60 | — | — | — | 9 |
| | 23 | 0.005 | 0.009 | 0.68 | 0.29 | 16.5 | 1.46 | 0.09 | 0.006 | 0.0003 | 0.12 | 0.58 | — | — | 15 |
| | 24 | 0.008 | 0.015 | 0.36 | 0.12 | 13.7 | 1.36 | 0.15 | 0.01 | 0.0013 | 0.05 | — | 1.02 | — | 9 |
| | 25 | 0.004 | 0.019 | 0.37 | 0.25 | 11.2 | 1.18 | 0.13 | 0.06 | 0.0008 | 0.03 | — | — | 0.66 | 6 |

Nos. 1 to 10 in the table are invention steels, while Nos. 11 to 25 are comparative steels. No. 11 is steel with a record of use as Nb—Si steel. The underlines in Table 1 show values outside of the ranges which are prescribed in the present invention.

From the obtained finished sheets, a high temperature tensile test piece is obtained, a tensile test is run at 700° C., and the 0.2% yield strength is measured (based on JIS G 0567).

Further, to investigate the long-term high temperature strength stability, the high temperature yield strength after aging at 700° C. for 100 hours was measured.

Further, as the test of the oxidation resistance, a continuous oxidation test was run in the atmosphere at 900° C. for 200 hours to evaluate the presence of occurrence of abnormal oxidation (based on JIS Z 2281).

Furthermore, as evaluation of the workability at ordinary temperature, a JIS No. 13 B test piece was prepared and a tensile test was run in a direction parallel to the rolling direction to measure the elongation at break.

The required characteristics of the stainless steel sheet of the present invention, the high temperature yield strength and elongation at break at ordinary temperature, are at least the high temperature yield strength and elongation at break at ordinary temperature of No. 11 of the existing steel. Table 2 shows the results of evaluation. The underlines show values which deviate from the required characteristics of the stainless steel sheet of the present invention.

TABLE 2

| | Steel no. | 0.2% yield strength at 700° C. (no aging) (MPa) | 0.2% yield strength at 700° C. (after 700° C. × 100 hr aging) (MPa) | Presence of abnormal oxidation after 200 hr continuous oxidation test at 900° C. | Elongation at break at ordinary temperature (%) |
|---|---|---|---|---|---|
| Inv. ex. | 1 | 98 | 46 | None | 34 |
| | 2 | 103 | 40 | None | 35 |
| | 3 | 120 | 113 | None | 33 |
| | 4 | 106 | 41 | None | 35 |
| | 5 | 111 | 57 | None | 33 |
| | 6 | 99 | 50 | None | 36 |
| | 7 | 101 | 39 | None | 35 |
| | 8 | 120 | 66 | None | 33 |
| | 9 | 119 | 75 | None | 33 |
| | 10 | 115 | 63 | None | 33 |
| Comp. ex. | 11 | 97 | 37 | None | 33 |
| | 12 | 75 | 33 | Yes | 27 |
| | 13 | 78 | 35 | Yes | 25 |
| | 14 | 111 | 36 | None | 29 |
| | 15 | 100 | 40 | None | 31 |
| | 16 | 90 | 30 | Yes | 36 |
| | 17 | 80 | 36 | None | 35 |
| | 18 | 156 | 125 | Yes | 24 |
| | 19 | 98 | 35 | None | 32 |
| | 20 | 93 | 34 | None | 31 |
| | 21 | 115 | 43 | None | 31 |
| | 22 | 108 | 49 | None | 29 |
| | 23 | 126 | 70 | None | 30 |
| | 24 | 129 | 77 | None | 28 |
| | 25 | 125 | 73 | None | 29 |

As clear from Table 2, the steel which has the composition of ingredients which is prescribed in the present invention has a higher high temperature yield strength at 700° C. compared with an existing steel to which a large amount of Nb is added (No. 11). In particular, the high temperature yield strength after heat treatment for aging is high and is superior in heat stability. Further, there is no problem with abnormal oxidation, in the mechanical properties at ordinary temperature, the fracture ductility is that of the comparative steel or more, and the workability is also excellent.

Nos. 12 and 13 of the comparative steels respectively have C and N which are outside the upper limits which are prescribed in the present invention, so are inferior in high temperature strength, oxidation resistance, and workability.

No. 14 has an amount of Si which is outside the upper limit which is prescribed in the present invention, so is inferior in workability and is low in strength after aging.

No. 15 has an amount of Mn outside the upper limit prescribed in the present invention and is inferior in workability.

No. 16 has an amount of Cr which is smaller than the lower limit which is prescribed in the present invention, so is low in high temperature strength and, furthermore, is also inferior in oxidation resistance.

No. 17 has an amount of Cu which is smaller than the lower limit which is prescribed in the present invention, so is low in high temperature strength.

No. 18 has an amount of Cu which is outside the upper limit which is prescribed in the present invention, so is inferior in oxidation resistance and workability.

Nos. 19 and 20 respectively have amounts of Nb and Ti which are outside the upper limits which are prescribed in the present invention and have Cu/(Ti+Nb) of less than 5, so are low in strength after aging and are inferior in workability.

Nos. 21 and 22 respectively have amounts of B and Al which are outside the upper limits which are prescribed in the present invention, so are inferior in workability.

Nos. 23, 24, and 25 respectively have amounts of Mo, V, and Sn which are outside the upper limits which are prescribed in the present invention, so are inferior in workability.

Table 3 shows the r-value and ordinary temperature elongation of finished sheet obtained by using hot rolled steel sheet of Steels 1, 5, 8, and 9 which are shown in Table 1, heat treating them, then cold rolling and annealing them under the conditions shown in Table 3.

TABLE 3

| Steel no. | Heat treatment temperature of hot rolled steel sheet (° C.) | Heat treatment time of hot rolled steel sheet (hours) | Average r-value | Ordinary temperature elongation at break (%) |
|---|---|---|---|---|
| 1 | 750 | 100 | 1.3 | 35 |
| 5 | 750 | 100 | 1.4 | 35 |
| 1 | 850 | 5 | 1.2 | 34 |
| 5 | 800 | 10 | 1.3 | 34 |
| 8 | 850 | 24 | 1.3 | 34 |
| 9 | 850 | 40 | 1.3 | 34 |
| 1 | None | None | 1.1 | 34 |
| 1 | 950 | 5 | 0.9 | 34 |
| 5 | 950 | 0.1 | 1.0 | 33 |
| 5 | 700 | 100 | 1.0 | 33 |
| 8 | 800 | 0.3 | 0.9 | 32 |
| 9 | None | None | 1.0 | 33 |

Here, the ordinary temperature elongation at break was measured by the above method.

The r-value is evaluated by obtaining a JIS No. 13 B tensile test piece, applying 15% strain in the rolling direction, direction 45° from the rolling direction, and direction 90° from the rolling direction, then using the following formula (1) and formula (2) to calculate the average r-value.

$$r=\ln(W0/W)/\ln(t0/t) \quad (1)$$

where, W0 is the sheet width before tension, W is the sheet width after tension, t0 is the sheet thickness before tension, and "t" is the sheet thickness after tension.

$$\text{Average } r\text{-value}=(r0+2r45+r90)/4 \quad (2)$$

where, r0 is the r-value of the rolling direction, r45 is the r-value in the direction 45° from the rolling direction, and r90 is the r-value in the direction 90° from the rolling direction.

From the results of Table 3, it was confirmed that the average r-value is improved when performing heat treatment under the preferred heat treatment conditions of the present invention. Accordingly, it is learned that the steel which is produced by the preferable heat treatment conditions of the present invention are improved in not only the ordinary temperature ductility but also the deep drawability.

INDUSTRIAL APPLICABILITY

According to the present invention, even if not adding a large amount of expensive alloy elements such as Nb and Mo, it is possible to provide stainless steel sheet which is excellent in high temperature characteristics and workability. By applying this in particular to an exhaust member, the contribution to society such as reduction on the environmental load due to the reduction in part costs and reduction in weight is extremely great.

The invention claimed is:

1. A ferritic stainless steel sheet excellent in heat resistance and workability, comprising, by mass %, C: less than 0.010%,
N: 0.020% or less,
Si: over 0.1% to 2.0%,
Mn: 0.28 to 2.0%,
Cr: 12.0 to 25.0%,
Cu: over 0.9% to 2.0%,
Ti: 0.05 to 0.3%,
Nb: 0.001 to 0.1%,
Al: 1.0% or less, and
B: 0.0003 to 0.0030%,
having a content of Cu, Ti, and Nb satisfying Cu/(Ti+Nb) ≥5, and
having a balance of Fe and unavoidable impurities,
wherein the steel sheet has a 0.2% yield strength at 700° C. after 700° C.×100 hours aging of the steel sheet of 39 MPa or more.

2. The ferritic stainless steel sheet of claim 1, further comprising, by mass %, one or more of
Mo: 0.50% or less,
V: 0.50% or less, or
Sn: 0.50% or less.

3. A method for producing a ferritic stainless steel sheet excellent in heat resistance and workability, the method comprising the steps of:

hot rolling a slab, then
performing heat treatment at 700 to 850° C. for 1 to 100 hr, then
cold rolling and annealing to obtain the steel sheet,
wherein the slab has a composition, comprising, by mass %,
C: less than 0.010%,
N: 0.020% or less,
Si: over 0.1% to 2.0%,
Mn: 0.28 to 2.0%,
Cr: 12.0 to 25.0%,
Cu: over 0.9% to 2.0%,
Ti: 0.05 to 0.3%,
Nb: 0.001 to 0.1%,
Al: 1.0% or less, and
B: 0.0003 to 0.0030%,
having a content of Cu, Ti, and Nb satisfying Cu/(Ti+Nb) ≥5, and
having a balance of Fe and unavoidable impurities, and
wherein the steel sheet has a 0.2% yield strength at 700° C. after 700° C.×100 hours aging of the steel sheet of 39 MPa or more.

4. The ferritic stainless steel sheet of claim 1, further comprising Cr in an amount, by mass %, of 12.0 to 17.2%.

5. The method of claim 3, wherein the slab further comprises Cr in an amount, by mass %, of 12.0 to 17.2%.

6. The method of claim 3, wherein the slab further comprises, by mass %, one or more of Mo: 0.50% or less,
V: 0.50% or less, or
Sn: 0.50% or less.

7. The ferritic stainless steel sheet of claim 4, further comprising, by mass %, one or more of Mo: 0.50% or less,
V: 0.50% or less, or
Sn: 0.50% or less.

8. The method of claim 5, wherein the slab further comprises, by mass %, one or more of Mo: 0.50% or less,
V: 0.50% or less, or
Sn: 0.50% or less.

9. The method of claim 3, wherein Cu particles are precipitated in the slab having a size of 50 nm or more before cold rolling.

* * * * *

UNITED STATES PATENT AND TRADEMARK OFFICE

CERTIFICATE OF CORRECTION

PATENT NO. : 8,980,018 B2
APPLICATION NO. : 13/636391
DATED : March 17, 2015
INVENTOR(S) : Junichi Hamada et al.

It is certified that error appears in the above-identified patent and that said Letters Patent is hereby corrected as shown below:

In the specification

Column 1, line 7, change "Application No. PCT/JP2001/058373" to -- Application No. PCT/2011/058373 --.

Signed and Sealed this
Fifth Day of January, 2016

Michelle K. Lee

Michelle K. Lee
*Director of the United States Patent and Trademark Office*